US007513382B2

(12) United States Patent
Clarke et al.

(10) Patent No.: US 7,513,382 B2
(45) **Date of Patent: *Apr. 7, 2009**

(54) LID WITH DRINK OPENING

(75) Inventors: Brian Norman Clarke, Huntingdon (GB); Peter Robert Wills, Huntingdon (GB); Nigel Frank Taylor, Huntingdon (GB)

(73) Assignee: Solo Cup Operating Corporation, Highland Park, IL (US)

( * ) Notice: Subject to any disclaimer, the term of this patent is extended or adjusted under 35 U.S.C. 154(b) by 372 days.

This patent is subject to a terminal disclaimer.

(21) Appl. No.: 11/443,584

(22) Filed: May 31, 2006

(65) Prior Publication Data

US 2006/0213908 A1 Sep. 28, 2006

Related U.S. Application Data

(63) Continuation of application No. 11/080,579, filed on Mar. 15, 2005, now Pat. No. 7,063,224, which is a continuation of application No. 10/165,190, filed on Jun. 7, 2002, now Pat. No. 6,874,649.

(30) Foreign Application Priority Data

Dec. 20, 2001 (GB) ..... 0130619.0

(51) Int. Cl.
*A47G 19/22* (2006.01)
*B65D 51/20* (2006.01)
*B65D 43/24* (2006.01)

(52) U.S. Cl. ..... 220/254.3; 220/268; 220/712; 220/713; 220/718; 220/832

(58) Field of Classification Search ..... 220/254.3, 220/712, 713, 718, 832, 265, 266, 268–270, 220/711, 717, 259.1, 810, 836, 839, 831
See application file for complete search history.

(56) References Cited

U.S. PATENT DOCUMENTS

| | | | | | |
|---|---|---|---|---|---|
| 3,262,612 | A | * | 7/1966 | Tabor | 222/484 |
| 3,994,411 | A | * | 11/1976 | Elfelt et al. | 220/712 |
| 4,138,033 | A | * | 2/1979 | Payne et al. | 220/254.3 |
| 4,183,443 | A | * | 1/1980 | DeParales et al. | 220/714 |
| 4,253,582 | A | * | 3/1981 | Shields | 220/269 |
| 4,331,255 | A | * | 5/1982 | Fournier | 220/257.2 |
| 4,333,583 | A | * | 6/1982 | Montemarano | 220/712 |
| 4,345,695 | A | * | 8/1982 | Galloway et al. | 220/254.6 |
| 4,430,103 | A | * | 2/1984 | Gray et al. | 62/620 |
| 4,629,088 | A | * | 12/1986 | Durgin | 220/254.3 |
| 4,738,373 | A | * | 4/1988 | DeParales | 220/254.3 |
| 4,796,774 | A | * | 1/1989 | Nabinger | 220/711 |

(Continued)

*Primary Examiner*—Anthony D Stashick
*Assistant Examiner*—Niki M Eloshway

(57) ABSTRACT

The present invention provides a lid for a beverage container. The lid has a mounting portion configured to connect the lid to the container and an annular side wall extending upward from the mounting portion. The lid also includes a top wall extending radially inward from the side wall, wherein the top wall has both a circular outer periphery and a circular inner periphery. An upwardly extending protrusion is pivotally connected to the top wall by a hinge. A central portion is positioned radially inward of the top wall, wherein the central portion has a circular outer periphery. The central portion is vertically positioned between the mounting portion and the top wall. The protrusion is pivotable about the hinge between a sealed position and an open position to define a drink opening residing entirely within the top wall.

26 Claims, 3 Drawing Sheets

U.S. PATENT DOCUMENTS 4,874,103 A * 10/1989 Quisenberry et al. ..... 220/254.3
5,090,584 A * 2/1992 Roberts et al. ..... 220/712
5,111,961 A * 5/1992 Van Melle ..... 220/712
5,197,624 A * 3/1993 Dodaro ..... 220/254.3
5,490,609 A * 2/1996 Lane et al. ..... 220/712
5,503,289 A * 4/1996 Fox ..... 220/254.3
5,613,619 A * 3/1997 Van Melle ..... 220/712
5,699,927 A * 12/1997 Lane et al. ..... 220/254.3
5,839,601 A * 11/1998 Van Melle ..... 220/712
5,911,331 A * 6/1999 Boller ..... 220/254.3
6,089,397 A * 7/2000 Van Melle ..... 220/270
6,612,456 B1 * 9/2003 Hundley et al. ..... 220/254.3
6,874,649 B2 * 4/2005 Clarke et al. ..... 220/254.3
7,063,224 B2 * 6/2006 Clarke et al. ..... 220/254.3

* cited by examiner

LID WITH DRINK OPENING

CROSS-REFERENCE TO RELATED APPLICATIONS

This application is a continuation of U.S. patent application Ser. No. 11/080,579, filed Mar. 15, 2005, now U.S. Pat. No. 7,063,224, issued Jun. 20, 2006, which is a continuation of U.S. patent application Ser. No. 10/165,190, filed Jun. 7, 2002, now U.S. Pat. No. 6,874,649, issued Apr. 5, 2005, which are incorporated herein by reference and made a part hereof, and upon which a claim of priority is based. Parent U.S. application Ser. No. 10/165,190 is a U.S. national filing claiming priority from pending United Kingdom Application No. 0130619.0 filed Dec. 20, 2001.

TECHNICAL FIELD

This invention relates to lids for containers, such as "take-away" hot and cold beverage cups.

BACKGROUND OF THE INVENTION

Conventionally, various types of lids are used for disposable containers, e.g., disposable plastic or paper cups for hot or cold beverages, such as are used by "fast food" and "take-away" outlets. Such lids are intended to provide a degree of retention of the beverage in the container when that container is accidentally knocked, shaken or tilted, whilst also allowing the beverage to be consumed as required. Such containers and lids, being single-use disposable items, must be capable of being produced at a low cost.

SUMMARY OF THE INVENTION

A typical disposable lid for such a beverage container is formed from thick plastics sheet material, for example by vacuum forming, and comprises a top panel with a downwardly depending peripheral rim. The plastics material of the lid is resiliently flexible so that the lid can be fifed over the open top of a suitably sized beverage container so that the rim of the lid grips the rim of the open end of the container, whereby the beverage is retained within the container.

In a known development of the basic plastic lid described above, a lid is provided with an aperture positioned at a point near to the rim of the lid. The aperture is chosen so that it is sufficiently enlarged to allow a user to drink from the container without having to remove the lid itself, but sufficiently small to reduce the risk of spillage of the beverage if the container is tilted or shaken. In addition, the aperture may be initially blocked by a press out tab or flap which can be pushed into the container when initial discharge of the beverage is required. However, such press-out tabs or flaps can be difficult to press out without a suitable instrument, which the purchaser of a beverage in a container fitted with the lid may not have handy.

It is therefore an object of the present invention to provide a lid which can be fitted to a container to prevent spillage of the contents while allowing an opening of restricted size to be produced readily in the lid for access to the contents of the container.

According to the present invention there is provided a lid for a beverage cup, the lid being moulded from resiliently flexible sheet material and comprising a projecting portion having a base connected with the remainder of the lid along a boundary formed in part by a living hinge and in the remaining part by a line of weakness such that by applying pressure to one side of said projection, the base of said projecting portion can be caused to break off from the material of the remainder of the lid along said line of weakness and the projection caused to pivot with respect to the remainder of the lid about said living hinge, and wherein, furthermore, said remainder of the lid includes catch means capable of co-operating with a free end of the projection when the latter is so pivoted beyond a predetermined extent, to retain the projection in its pivoted position until forcefully displaced back towards its initial position.

Preferably, the lid has a generally planar rim and said base of said projecting portion, and in particular said living hinge, is further from said plane than said catch means, and wherein said catch means is afforded by a shoulder defined by a first wall portion meeting a top wall portion, said first wall portion having a lower edge nearer to said plane of said rim than is said top wall portion and said shoulder being nearer said projecting portion than said lower edge, said shoulder being so located and the lid structure being so resiliently flexible that, in the course of pivoting the projecting portion, about said living hinge, away from its initial position, the tip of said projecting portion can engage said top wall portion adjacent said shoulder and such that further pivoting forcefully in the same direction allows the tip of said projecting portion to be forced past said shoulder to be retained by engagement with said first wall portion.

The lid may, as with conventional disposable lids for the same purpose, be formed by a vacuum forming or similar process carried out on an initially flat, thin sheet of plastics material deformable or mouldable when sufficiently heated, and may thus have, as with conventional lids, a peripheral edge or rim lying substantially in a plane which is substantially that of the original sheet plastics material before moulding.

In manufacture of the preferred form of lid in accordance with the invention, by a vacuum forming or similar process, know per se, a large number of such lids is formed simultaneously from an initially flat thin sheet of thermoplastics material heated to a temperature at which it is plastically deformable, and which process displaces, out of the plane of the sheet, portions defining the top and a surrounding rim of each lid. The line of weakness around the base of said projecting portion may be formed at this stage by a punching operation or an operation in which a cut is made through only part, e.g., half, the thickness of the plastics material.

BRIEF DESCRIPTION OF THE DRAWINGS

Embodiments of the invention are described below by way of example with reference to the accompanying drawings, in which.

DETAILED DESCRIPTION OF THE PREFERRED EMBODIMENT

Figure 1:
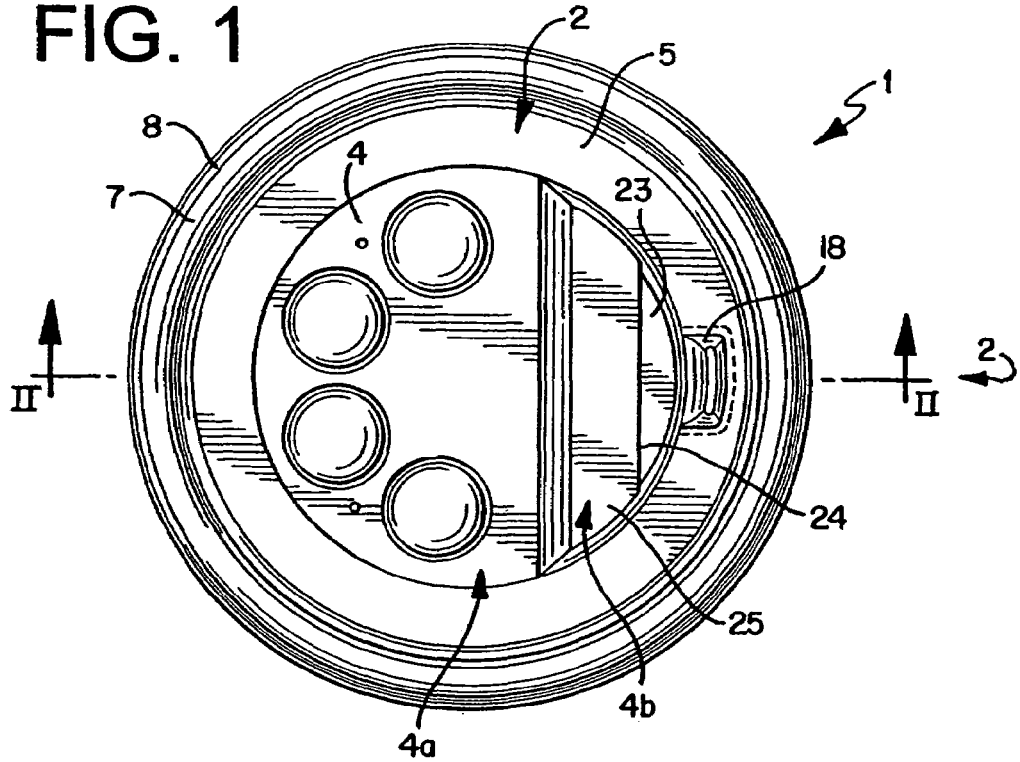
FIG. 1 is a plan view of a lid embodying the invention in an initial, closed condition.
Figure 2:
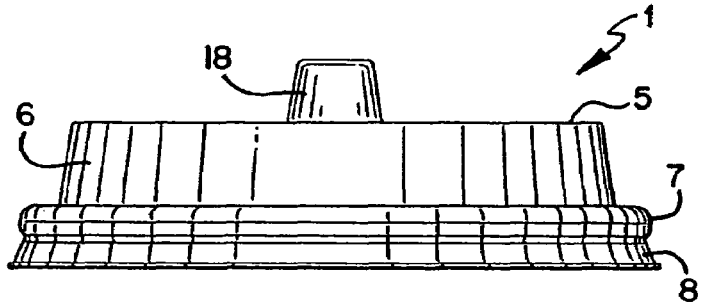
FIG. 2 is a side view looking in the direction of the arrow 2 in FIG. 1.

The lids shown in the drawings are made, as lids of this general sort commonly are, by subjecting a thin, initially flat, planar sheet of thermoplastics material to a forming process, such as a vacuum forming or pressing process, whilst it is at a temperature at which it is readily plastically deformable, the effect of the process being to displace some of the material of the sheet to predetermined extents out of the original plane of the sheet material. After such deformation, the plastics material is severed around the moulded regions which define the lids, to free the lids from the remainder of the sheet material. The plastics material used is of a resiliently flexible character at temperatures below its softening point or range.

The figures show a lid 1 having a circular body portion 2 which includes a central region 4, surrounded by an elevated, generally planar circumferential annular region 5 from which a projecting portion 18 is upstanding at one circumferential position on the lid. The circular annular region 5 is bounded, at its outer edge, by a circumferential wall 6, sloping downwards and outwardly from the edge of circular region 5 to a level below that of the central region 4. The lower edge of wall 6 merges with a region of arcuate vertical cross-section, which defines a resilient rib 7 which projects outwardly from the bottom of the wall 6. Extending from the base of the rib 7, on the side opposite the wall 6, is a generally frusto-conical, resilient skirt 8, defining a peripheral edge 9 lying in a plane which corresponds to the plane of the undeformed sheet material from which the lid was formed as described above. A major part 4*a* of the central region 4 surrounded by the elevated, generally planar circular annular region 5, is generally planar, but a segment, (in the geometrical sense), 4*a* of this central region is recessed below the plane of part 4, and significantly below the level of annual region 5 with the projecting portion 18 being disposed centrally with respect to the circular arc defined by this segment.

The projecting portion 18 has a base, in the plane of the annular planar region 5, which is approximately rectangular in plan (see FIG. 1), the projecting portion comprising a first side 17 which is effectively an upward continuation of the adjoining side wall of the segment-shaped recess 45, and an outer wall 19 which extends again upwardly and somewhat inwardly towards the central vertical axis of the lid to a rounded or blunt "point" 20 of the projection. The projection 18 further has two side walls extending upwardly and towards each other towards the free end or "point" 20 of the projection, whereby the projection 18 has a chisel-like configuration. In the initial state of the lid, three sides of a base of the projection 18 are defined by respective lines of weakening, for example formed by grooves or even interrupted slits in the plastics material of the planar annular region 5 adjacent, respectively, the lower end of the outer wall 19 and the lower ends of the two side walls. The remaining inner wall, 17 of the projection 18 is continuous with the adjacent wall of the segment-shaped recess except that a slight indentation 21, dividing the inner wall 17 of the projection 18 from the inner wall of the segmental recess 4*b* defines a localised region of high flexibility constituting a so-called "living hinge."

In use, a cup containing a beverage and fitted with the lid illustrate will be provided to a customer sealed at the point of sale—that is to say the projection 18 will be in its initial position shown in FIGS. 1 to 5 with the base of the projection 18 still attached to the adjoining part of the lid along all four sides of the projection. When the customer wishes to access the beverage he or she must apply a lateral force to the projection 18, for example by pushing it to the left in FIGS. 1, 3, 4 and 5 or by pinching the outer and inner walls (17, 19) of the projection 18 together, to rupture the weakened connection of the base of the projection 18 with the adjoining parts of the lid along the outer and side walls of the projection 18. Pivotal movement of the projection 18, thereafter, in an anticlockwise sense as viewed in FIGS. 5 and 6, causes the projection to execute a pivotal movement about the aforesaid living hinge 21.

Figure 3:
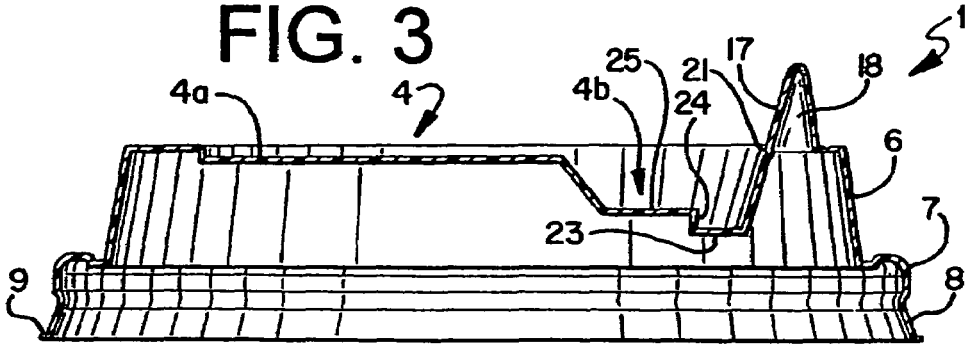
FIG. 3 is a view in section along the line II-II in FIG. 1.
Figure 4:
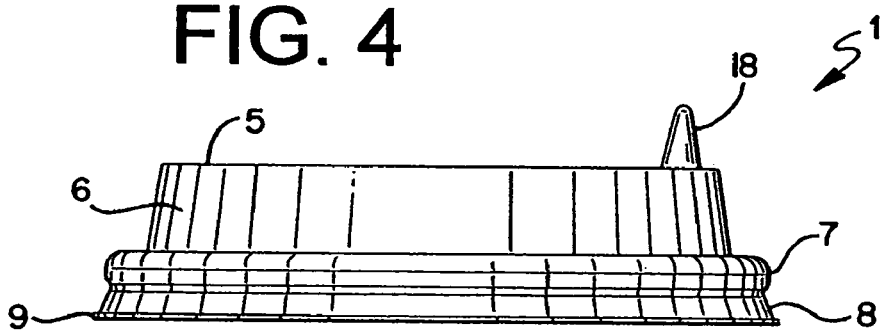
FIG. 4 is a corresponding side view.
Figure 5:
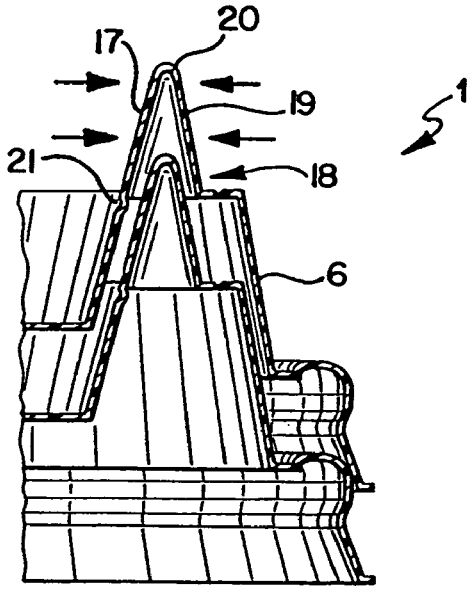
FIG. 5 is a fragmentary view in section along with line II-II of FIG. 1 to a larger scale.
Figure 6:
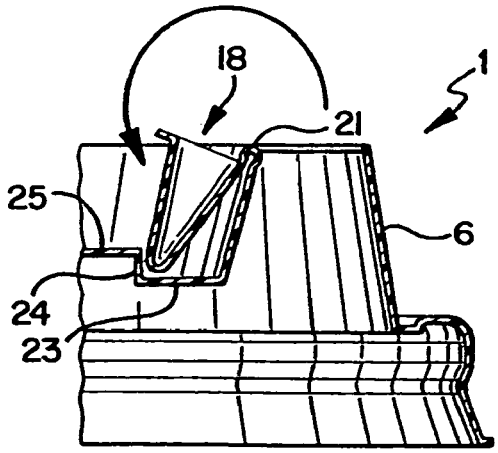
FIG. 6 is a corresponding view but showing the projecting portion separated from the remainder of the lid along the line of weakness and bent back on the living hinge to a retaining position.

Referring to FIGS. 1, 3 and 6, the recessed segment 4B has a lowermost portion 23 (i.e. a portion nearest the plane of the rim 9), which is parallel with the latter plane and extends to the bottom of the inner side wall of the recess 4B of which the wall 17 is an upward continuation. This portion 23 terminates, opposite the projection 18, in the lower edge of a first wall portion 24 which extends chordally as viewed in plan (FIG. 1) and which extends vertically upwardly from a lower edge, where it meets the portion 23, to a shoulder defined where the first wall portion 24 meets a top wall 25. (The top wall 25 nevertheless lies below the level of portion 4A and below the plane of annular recess 5) and thus below the plane of the base of projection 18. The location of the shoulder defined between the first wall portion 24 and the top wall portion 25 is such that, when the projection 18 is first pivoted anticlockwise as viewed in FIG. 6, away from its original position, the tip 20 of the projection 18 first strikes the top wall 25 closely adjacent the wall 24. However, the manual application of a slight additional force tending to pivot the projection 18 anticlockwise in FIG. 6 is sufficient to displace the relevant portions of the lid resiliently sufficiently to allow the tip 20 of the projection 18 to pass the shoulder defined between walls 24 and 25 into the recess defined above the lower horizontal wall portion 23. The projection 18 is thereafter retained in the last-mentioned position by engagement with the side wall 24 until and unless forced back manually to pass the shoulder defined between walls 24 and 25, (although there will normally be no useful purpose to be served by moving the projection 18 back out of its retained position illustrated in FIG. 6).

Figure 7:
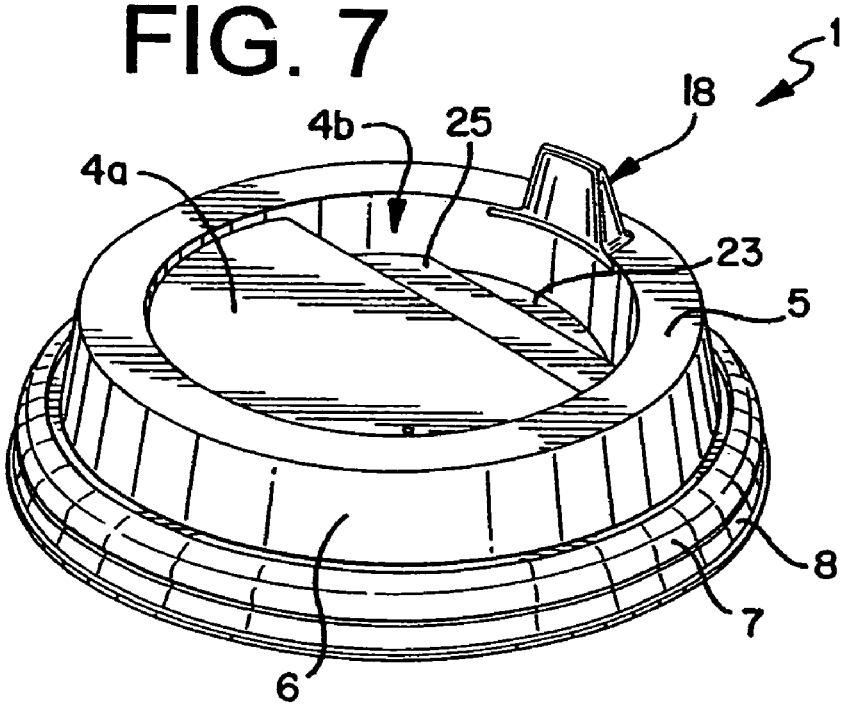
FIG. 7 is a perspective view of the lid with the projecting portion in its original, undisplaced position; and, FIG. 8 is a perspective view of the lid with the projecting portion bent back and retained in an open position.
Figure 8:
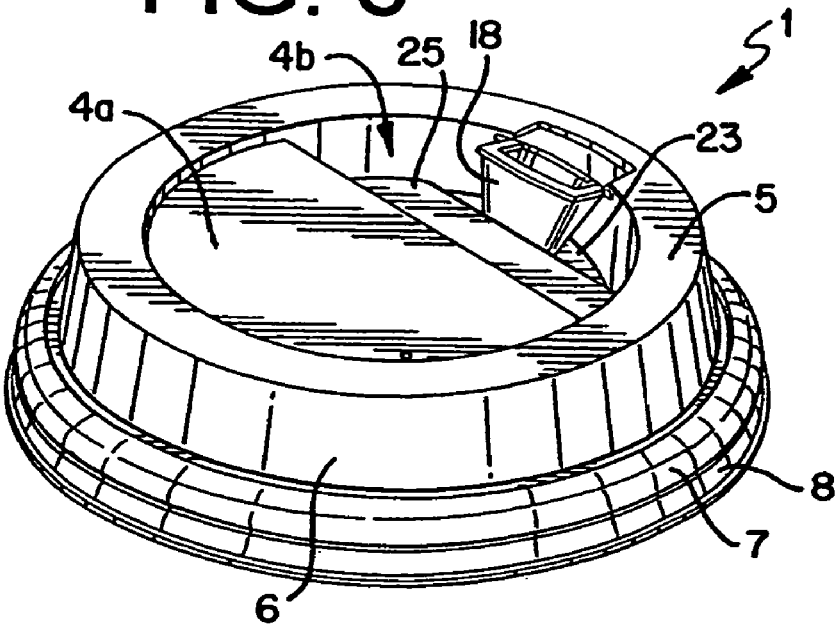

FIG. 7 and FIG. 8 are perspective views of the lid of FIGS. 1 to 6 showing the lid, respectively, in the original position, with the projection 18 projecting upwardly and (FIG. A) showing the projection 18 in the position in which it has been folded back and is retained by the shoulder formed between wall 24 and to wall 25.

What is claimed is:

1. A lid for a container holding a flowable substance, the lid comprising:

a mounting portion configured to connect the lid to the container;

an annular side wall extending upward from the mounting portion;

a top wall extending radially inward from the side wall, the top wall having both a circular outer periphery and a circular inner periphery, the top wall further having an upwardly extending protrusion pivotally connected to the top wall by a hinge;

a central portion positioned radially inward of the top wall, the central portion having a circular outer periphery and being vertically positioned between the mounting portion and the top wall; and, wherein the protrusion is pivotable about the hinge between a sealed position and an open position to define a drink opening residing entirely within the top wall.

2. The lid of claim 1, wherein the protrusion has a first pair of opposed side walls that converge.

3. The lid of claim 2, wherein the first pair of converging side walls define an apex in an upper portion of the protrusion.

4. The lid of claim 2, wherein the protrusion has a second pair of opposed walls that converge.

5. The lid of claim 1, wherein an internal side wall extends downward from the inner periphery of the top wall to the central portion, the internal side wall terminating at a vertical position above the mounting portion.

6. The lid of claim 1, wherein the central portion includes a first segment and a second segment, the first segment residing between the drink opening and the second segment, and wherein the first segment is positioned below the second segment to define a lip recess radially inward of drink opening.

7. The lid of claim 1, wherein the hinge is located proximate the inner periphery of the top wall.

8. The lid of claim 1, wherein in the open position the protrusion is secured below a plane in which the top wall resides.

9. A thermoformed lid for a beverage container, the lid comprising:

a mounting portion having a circular outer periphery;

a top wall having a circular inner periphery, the top wall having a segment with a an upwardly extending protrusion and a rupturable seam positioned about the protrusion, the segment further having a hinge extending between opposed ends of the seam;

a side wall extending vertically between the mounting portion and the top wall;

a central portion positioned radially inward of the top wall, the central portion having a circular outer periphery; and, wherein the protrusion is pivotable about the hinge between a closed position and an open position to define a drink open residing entirely within the top wall, and wherein the protrusion is retained in the open position below a plane in which the top wall resides.

10. The thermoformed lid of claim 9, wherein the top wall has a circular outer periphery, the protrusion and the seam being positioned between outer periphery and the inner periphery of the top wall.

11. The thermoformed lid of claim 9, wherein the protrusion has a first pair of opposed side walls that converge to define an apex.

12. The thermoformed lid of claim 11, wherein in the open position, the apex resides below the plane in which the top wall resides.

13. The thermoformed lid of claim 9, wherein an internal side wall extends downward from the inner periphery of the top wall to the central portion, the internal side wall terminating at a vertical position above the mounting portion.

14. A thermoformed lid for a beverage container, the lid comprising:

a mounting portion having a circular outer periphery and configured to connect the lid to the container;

a side wall extending upward from the mounting portion;

a top wall extending radially inward from the side wall, the top wall having a segment with a rupturable seam and a hinge, the top wall further having a protrusion extending upwardly from the segment, the protrusion having an apex defined by a first pair of opposed walls that converge;

a central portion positioned radially inward of the top wall and having a circular outer periphery, and, wherein the protrusion has a first sealed position, and a second position where upon rupture of the seam, the protrusion is pivotable about the hinge to define a drink opening in the top wall.

15. The thermoformed lid of claim 14, wherein the protrusion has a second pair of opposed walls that converge.

16. The thermoformed lid of claim 14, wherein the top wall has both a circular outer periphery and a circular inner periphery.

17. The thermoformed lid of claim 16, wherein an internal side wall extends downward from the inner periphery of the top wall to the central portion, the internal side wall terminating at a vertical position above the mounting portion.

18. The thermoformed lid of claim 14, wherein the central portion includes a first segment and a second segment, the first segment residing between the drink opening and the second segment, and wherein the first segment is positioned below the second segment to define a lip recess radially inward of drink opening.

19. The thermoformed lid of claim 14, wherein in the second position the protrusion is secured below a plane in which the top wall resides.

20. The thermoformed lid of claim 19, wherein the apex engages a portion of the lid to retain the protrusion in the second position.

21. The thermoformed lid of claim 19, wherein an internal side wall extends downward from the inner periphery of the top wall to the central portion, the internal side wall terminating at a vertical position above the mounting portion.

22. The thermoformed lid of claim 19, wherein in the end wall of the protrusion engages a portion of the lid to retain the protrusion in the open position.

23. The thermoformed lid of claim 22, wherein protrusion is secured below the top wall in the open position.

24. A thermoformed lid for a beverage container, the lid comprising:

a mounting portion configured to connect the lid to the container;

a top wall having a circular inner periphery and a segment positioned radially outward of the inner periphery, the segment having a rupturable seam, a hinge and an upwardly extending protrusion, the protrusion having a first pair of opposed walls that converge to define a rounded upper end wall;

an annular side wall extending vertically between the mounting portion and the top wall; and, wherein the protrusion is pivotable about the hinge between an initial sealed position, and an open position upon rupture of the seam to define a drink opening residing entirely within the top wall.

25. The thermoformed lid of claim 24, wherein the protrusion has a second pair of opposed walls that converge.

26. The thermoformed lid of claim 24, wherein the top wall has a circular outer periphery and the segment is positioned between the outer periphery and the inner periphery.

* * * * *